US010414418B2

(12) United States Patent
Martin

(10) Patent No.: US 10,414,418 B2
(45) Date of Patent: Sep. 17, 2019

(54) CABLEWAY INSTALLATION

(71) Applicant: POMA, Voreppe (FR)

(72) Inventor: Sébastien Martin, Voreppe (FR)

(73) Assignee: POMA, Voreppe (FR)

( * ) Notice: Subject to any disclaimer, the term of this patent is extended or adjusted under 35 U.S.C. 154(b) by 224 days.

(21) Appl. No.: 15/376,235

(22) Filed: Dec. 12, 2016

(65) Prior Publication Data

US 2017/0166227 A1 Jun. 15, 2017

(30) Foreign Application Priority Data

Dec. 11, 2015 (FR) ..... 15 62254

(51) Int. Cl.

| | |
|---|---|
| ***B61K 13/04*** | (2006.01) |
| ***B61B 1/02*** | (2006.01) |
| ***B61B 7/00*** | (2006.01) |
| ***B61B 12/00*** | (2006.01) |
| ***B61B 12/06*** | (2006.01) |
| ***B61L 23/04*** | (2006.01) |

(52) U.S. Cl.

CPC ..... *B61K 13/04* (2013.01); *B61B 1/02* (2013.01); *B61B 7/00* (2013.01); *B61B 12/00* (2013.01); *B61B 12/06* (2013.01); *B61L 23/04* (2013.01)

(58) Field of Classification Search

CPC ..... B61B 10/00; B61B 10/02; B61B 11/00; B61K 13/00; B61K 13/04

See application file for complete search history.

(56) References Cited

U.S. PATENT DOCUMENTS

| | | | | |
|---|---|---|---|---|
| 7,802,523 | B2 * | 9/2010 | Moritzhuber | B61B 7/00 104/173.1 |
| 2007/0221088 | A1 * | 9/2007 | Hinteregger | B61B 7/00 104/178 |
| 2010/0018434 | A1 | 1/2010 | Moritzhuber et al. | |

FOREIGN PATENT DOCUMENTS

| | | | |
|---|---|---|---|
| EP | 2147843 | A1 | 1/2010 |
| EP | 2716516 | A1 | 4/2014 |
| JP | H1178866 | A | 3/1999 |
| WO | 2012/172198 | A1 | 12/2012 |
| WO | 2013/182803 | A1 | 12/2013 |

* cited by examiner

*Primary Examiner* — Robert J McCarry, Jr.
(74) *Attorney, Agent, or Firm* — Oliff PLC

(57) ABSTRACT

Cableway installation including at least one vehicle designed to be hauled by the cable, a loading terminal including a boarding area where passengers are positioned to board the vehicle, a drive motor of the vehicle in the boarding area, image acquisition device generating at least one image representative of the vehicle and of the passengers in the boarding area, and an electronic control unit configured to determine a surveillance area around the vehicle and the positions of the passengers, in the at least one representative image, and to generate a speed setpoint for the motor according to the positions of the passengers in the surveillance area.

14 Claims, 2 Drawing Sheets

CABLEWAY INSTALLATION

BACKGROUND OF THE INVENTION

The invention relates to cableways, and more particularly to cableway installations with aerial hauling cables.

STATE OF THE ART

At the present time, boarding of passengers into/onto the vehicles of a cableway installation is a delicate affair. For certain installations of cable car or chair lift type, the passengers have to board when the vehicles are moving, and there may be a risk of untimely collision between the vehicle and a passenger when the latter is not correctly placed with respect to the vehicle. This is in particular the case for chair lifts when the passengers have to wait in front of the chairs in order to embark. Untimely collision is referred to when several passengers may try to embark on the same seat of a chair, or when they are next to the chair and are liable to be pushed by the chair and to fall without being able to get on the chair seat. Running of the vehicles therefore has to be stopped to evacuate or reposition the persons who are incorrectly placed. In order to avoid any risk of collision, an operator is responsible for helping the passengers to board and to stop the installation each time a risk of collision is imminent.

A requirement therefore exists to control boarding of passengers into/onto moving vehicles to prevent any risk of untimely collision.

OBJECT OF THE INVENTION

An object of the invention consists in palliating these shortcomings, and more particularly in providing an installation equipped with means for detecting risks of collision between the passengers and the vehicles, and for avoiding a number of untimely stoppages of the installation.

According to one feature of the invention, a cableway installation is proposed comprising at least one vehicle designed to be hauled by the cable, a passenger loading terminal comprising a boarding area where passengers are positioned to board the vehicle, and a drive motor of the vehicle in the boarding area.

The installation comprises an image acquisition device generating at least one image representative of the vehicle and of the passengers in the boarding area, and an electronic control unit configured to determine a surveillance area around the vehicle and the positions of the passengers, in said at least one representative image, and to generate a speed setpoint for the motor according to the positions of the passengers in the surveillance area.

Automated means is thus provided for preventing risks of accidents when loading passengers. The installation throughput rate is also improved as the speed of the vehicles can be adjusted according to the configuration of the boarding area. Imminent accident risk situations are identified to stop the cableway only when necessary, i.e. when the passengers can no longer be repositioned in a correct configuration.

The installation can comprise a support situated above the boarding area, the image acquisition device being mounted on the support directly above the boarding area.

The image acquisition device can generate several representative images.

The image acquisition device can be a digital video camera or an infrared thermal camera.

The surveillance area can comprise two lateral collision areas situated on each side of the vehicle and the electronic control unit generates a stop setpoint of the vehicle when at least one passenger is positioned in a lateral collision area.

The vehicle can be a chair comprising at least two seats to respectively seat at least two passengers.

The surveillance area can also comprise a frontal danger area situated to the front of the vehicle and the electronic control unit generates a stop setpoint of the vehicle when the number of passengers present in the frontal danger area is greater than the number of seats of the vehicle.

The frontal danger area can comprise at least two tracks respectively situated facing said at least two seats of the vehicle, and the electronic control unit generates a stop setpoint of the vehicle when more than one passenger is present on at least one track of the frontal danger area.

The surveillance area can comprise a safety area situated to the front of the frontal danger area and comprising at least two tracks respectively situated facing said at least two seats of the vehicle, and the electronic control unit generates an initial speed setpoint of the vehicle when one passenger at most is present on each track of the safety area.

The electronic control unit can generate a speed setpoint lower than the initial speed of the vehicle when more than one passenger is present on at least one track of the safety area.

The electronic control unit can generate a speed setpoint lower than the initial speed of the vehicle when the number of passengers present in the safety area is greater than the number of seats of the vehicle.

The boarding area can comprise a departure area, and the electronic control unit generates a stop setpoint of the vehicle when the vehicle is positioned in the departure area and when the number of passengers present in the frontal danger area is greater than the number of seats of the vehicle.

The electronic control unit can further generate a stop setpoint of the vehicle when the vehicle is positioned in the departure area and more than one passenger is present on at least one track of the frontal danger area.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
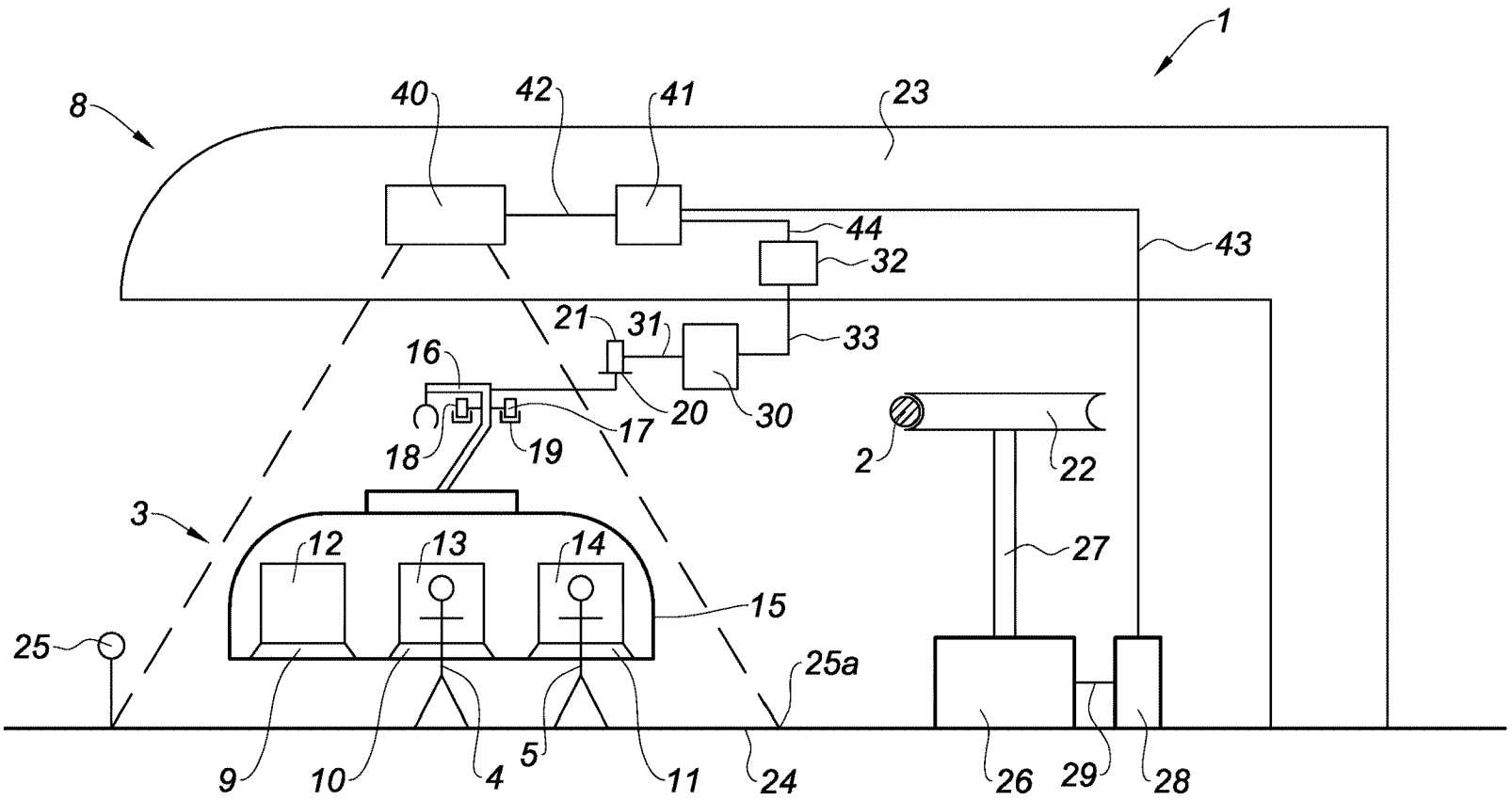
FIG. 1 schematically illustrates an embodiment of a cableway installation according to the invention.

In FIG. 1, an embodiment of a cableway installation 1 has been represented. The installation 1 comprises at least one vehicle 3 designed to be hauled by the cable 2 of the installation in order to transport passengers 4 to 7. The installation 1 is preferably a chair lift, for example of monocable type. A chair lift generally comprises several vehicles 3 being chairs, and the cable 2 is an aerial hauling cable, i.e. the chairs 3 are suspended above the ground. A single chair 3 has been represented in FIGS. 1 to 5 for the sake of simplification. The cable 2 is furthermore preferably both a hauling and carrier cable. The installation 1 comprises a loading terminal 8 where the passengers 4 to 7 board the chairs 3. The chairs 3 generally comprise at least two seats 9 to 11, or even several seats, placed next to one another. Each seat 9 to 11 is designed for a passenger 4 to 7 to be seated on. In general manner, a chair 3 comprises as many backrests 12 to 14 as seats 9 to 11, a chair structure 15 to which the backrests 12 to 14 and seats 9 to 11 are fixed, and a safety bar mounted pivoting to provide protection of the passengers seated on the chair 3, not represented for the sake of simplification. The chairs 3 further comprise a grip 16 to latch them to the cable 2. The grip 16 can be fixed, and in this case the chairs 3 are latched in permanent manner onto the cable 2. Preferentially, the grip 16 is detachable, and in this case the chairs 3 are latched in removable manner on the cable 2. In FIG. 1, a detachable chair lift has been represented where the grips 16 are detachable. In this case, the detachable grip 16 comprises two lateral wheels 17, 18 designed to run on rails forming a bypass circuit 19 so as to move the vehicles 3 at a lower speed than that of the cable 2 to facilitate boarding of the passengers 4 to 7. Indeed, when the chairs 3 are detached from the cable 2, they run in the loading terminal 8 with a lower speed than that of the cable 2. In order to move the vehicles 3 on the bypass circuit 19, the grips are also equipped with a plate 20 on which rotary sheaves 21, also called tyres, press and push the chairs 3 to move them on the bypass circuit 19. The loading terminal 8 also comprises a boarding area 24 where the passengers 4 to 7 wait before boarding the vehicles 3, and a support 23 situated above the boarding area 24. The loading terminal 8 can further comprise a barrier 25 movable between a closed position preventing the passengers 4 to 7 from accessing the boarding area 24 and an open position allowing access to the boarding area 24. The boarding area 24 is then situated between the barrier 25 and a departure line 25*a*. The terminal 8 can further comprise a driving pulley 22, mounted able to rotate to drive the hauling cable 2, and a main motor 26 configured to drive the driving pulley 22 by means of a drive shaft 27. In this case, the loading terminal 8 is called drive terminal 8. The loading terminal 8 can also comprise a tensioning pulley of the cable, called return pulley, and in this case the terminal 8 does not comprise the main motor 26 and is called return terminal. A drive terminal 8 has been represented for example purposes in FIG. 1. The main motor 26 is controlled by a main control unit 28, connected to the main motor 26 by a connection 29. The main control unit 28 controls the speed of rotation of the driving pulley 22, and therefore that of the cable 2.

Furthermore, when the grips 16 of the vehicles are fixed, movement of the vehicles 3 in the boarding area 24 is performed by means of the hauling cable 2 on which the vehicles 3 are latched. When the grips 16 are detachable, the vehicles 3 are moved in the boarding area 24 by means of the rotary sheaves 21. Indeed, when the rotary sheaves 21 are moved in rotation, they in fact press on the plate 20 of the vehicles 3, and can slow down, push and accelerate the vehicles 3. The rotary sheaves 21 can be made to rotate by means of the hauling cable 2, for example a torque transmission sheave can be placed in the terminal 8 in contact with the hauling cable 2 and be connected to the rotary sheaves 21 by means of a torque transmission device. The main control unit 28 thus controls the speed of movement of the vehicles 3 in the loading terminal 8.

As a variant, the terminal 8 can comprise a secondary motor 30 configured to drive the rotary sheaves 21 by means of secondary shafts 31. The secondary motor 30 is controlled by a secondary control unit 32 connected to the secondary motor 30 by a connection 33. The secondary control unit 32 thus controls the speed of rotation of the rotary sheaves 21 and therefore the speed of movement of the vehicles 3 in the loading terminal 8.

The cableway installation 1 further comprises an image acquisition device 40, an electronic control unit 41 coupled to the device 40 by a connection 42. The electronic control unit 41 is further coupled to the main control unit 28 by a connection 43. When the terminal comprises a secondary motor 30, the electronic control unit is coupled to the secondary control unit 32 by a connection 44.

The image acquisition device 40 is configured to acquire one or more successive images I1 to I4 of the boarding area 24. When the vehicles 3 are running through the boarding area 24, device 40 can generate images I1 to I4 representative of the boarding area 24, of the vehicles 3 and of the passengers 4 to 7 in the boarding area 24. Device 40 can be a digital video camera or an infrared thermal camera. Device 40 can be located close to the boarding area 24, i.e. outside the latter. Preferentially, device 40 is mounted on the support 23 directly above the boarding area 24. The support 23 can be a roof, a beam, a gantry, or generally a frame.

The electronic control unit 41 receives the images I1 to I4 generated and transmitted by device 40. The electronic control unit 41 is configured to process images I1 to I4. For example, the electronic control unit 41 comprises a processor, and in general manner electronic circuitry designed to perform logic image processing operations. The processor can be a graphic processor provided with memories, calculators and comparators configured to execute the image processing algorithm instructions.

The electronic control unit 41 can also generate speed setpoints and transmit them, via connection 44, to the secondary motor 30 or to the main motor 26, to adjust the speed of movement of the chairs 3 according to processing of the images I1 to I4. The electronic control unit 41 can further generate signalling information designed for a signalling device 50 located in the loading terminal 8. The signalling device 50 can be an indicator light, or an audible emitter, or a mechanical signalling system. The signalling device 50 enables to indicate whether a configuration of boarding area 24 is valid or not.

The electronic control unit 41 is configured to determine, from each image I1 to I4 received, a surveillance area 60 around the vehicle 3 of the image I1 to I4. The electronic control unit 41 also determines the positions of the passengers 4 to 7 in the image I1 to I4, and in particular their positions with respect to the vehicle 3, and more particularly their position with respect to the surveillance area 60. In other words, the electronic control unit 41 determines the presence or not of a passenger 4 to 7 in the surveillance area 60, and their positions in the surveillance area 60, so as to adjust the speed of the vehicle 3 according to a risk situation. The electronic control unit 41 generates a speed setpoint for the secondary motor 30, or the main motor 26, according to the positions of the passengers in the surveillance area 60.

In FIGS. 2 to 5, four images I1 to I4 processed by the electronic control unit 41 have been respectively represented. In general manner, the surveillance area 60 comprises two lateral collision areas 61, 62 situated on each side of the vehicle 3, and the electronic control unit 41 generates a stop setpoint of the vehicles when at least one passenger 4 to 7 is positioned in a lateral collision area 61, 62. Any risk of collision between the vehicle 3 and a passenger 4 to 7 situated near the lateral side of the vehicle 3 and who cannot board the vehicle 3 is thus prevented. The surveillance area 60 further comprises a frontal danger area 64 located to the front of the vehicle 3, and the electronic control unit 41 generates a stop setpoint of the vehicles 3 when the number of passengers 4 to 7 present in the frontal area 64 is greater than the number of seats 9 to 11 of the vehicles 3. This configuration can occur when there are more passengers than seats present in the boarding area 24. In this way, when the passengers 4 to 7 are too close to the chair 3 and their number is greater than the number of seats 9 to 11, the passengers 4 to 7 cannot all board the chairlift and driving of the vehicles 3 is then stopped.

Preferentially, the frontal danger area 64 comprises as many tracks 65 to 67 as seats 9 to 11. Each track 65 to 67 of the frontal danger area 64 is located facing a seat 9 to 11 of the vehicle 3. The electronic control unit 41 further generates a stop setpoint of the vehicles 3 when more than one passenger is present on at least one track 65 to 67 of the frontal danger area 64.

The surveillance area 60 can also comprise a safety area 68 situated to the front of the frontal danger area 64 and comprising as many tracks 75 to 77 as seats 9 to 11. Each track of the safety area 68 is situated facing a seat 9 to 11 of the vehicle 3. In particular the tracks 75 to 77 of the safety area 68 are respectively situated in the extension of the tracks 65 to 67 of the frontal danger area 64. The electronic control unit 41 can then generate a speed reduction setpoint of the vehicles 3 when more than one passenger 4 to 7 is present on at least one track 75 to 77 of the safety area 68. Reduction of the speed of the vehicles 3 enables sufficient time for the passengers 4 to 7 to be able to move to a correct position in order to be able to board the vehicle 3.

The electronic control unit 41 can also generate a speed reduction setpoint of the vehicles 3 when the number of passengers 4 to 7 present in the safety area 68 is greater than the number of seats 9 to 11 of the vehicles 3.

Furthermore, the boarding area 24 can comprise at least one departure area 80 and a preparation area 81. As a variant, the boarding area 24 can comprise a third entry area 82 contiguous to the preparation area 81. The electronic control unit 41 can generate a stop setpoint of the vehicles 3 when a vehicle 3 is positioned in the departure area 80 and when the number of passengers 4 to 7 present in the frontal danger area 64 is greater than the number of seats 9 to 11 of the vehicle 3, or when more than one passenger 4 to 7 is present on at least one track of the frontal danger area 64.

In general manner, to board a chair 3 of a chair lift correctly, a single passenger 4 to 7 has to be placed facing a seat 9 to 11. In this case, the configuration of the passengers, or the configuration of the boarding area 24, is said to be valid. The electronic control unit 41 therefore enables a risk configuration to be determined, i.e. when the number of passengers 4 to 7 situated in the safety area 68 is greater than the number of seats 9 to 11, or when there is more than one passenger situated on a track of the safety area 68. In this case, a valid configuration can still be obtained in which there is not more than one passenger per track of the safety area 68. For example, it is possible to go from a risk configuration to a valid configuration by repositioning the passengers 4 to 7 in such a way that there is one passenger per track of the safety area 68. The excess passengers can also be removed from the boarding area 24. So long as the configuration of the boarding area 24 is valid, the vehicles 3 are driven in the boarding area 24 with an initial speed. When the vehicles 3 are equipped with fixed grips, the initial speed corresponds to the speed of the cable 2. When the vehicles 3 are equipped with detachable grips, the initial speed is lower than the speed of the cable 2. When the electronic control unit 41 determines a risk configuration, it generates a speed setpoint to adjust the speed of movement of the vehicle 3. More particularly, the value of the setpoint speed is lower than the initial speed in order to slow the vehicles 3 down. In particular, when the vehicle 3 is in the entry area 82 and when a risk configuration is determined, the speed of the vehicles 3 is modified to a first speed lower than the initial speed. When the vehicle 3 is in the preparation area 81 and when a risk configuration is determined, the speed of the vehicles is modified to a second speed lower than the first speed. When the vehicle 3 is in the departure area 80 and when a risk configuration is determined, the vehicles 3 are stopped as a valid configuration can no longer be obtained.

The electronic control unit 41 can determine a dangerous configuration, i.e. when there is at least one passenger situated in at least one lateral danger area 61, 62, or when the number of passengers 4 to 7 situated in the danger area 64 is greater than the number of seats 9 to 11. In this case, a valid configuration can no longer be obtained and the electronic control unit stops movement of the vehicles 3. Inversely, when the electronic control unit 41 determines that there is no longer a risk configuration or a dangerous configuration, it re-establishes the initial speed setpoint in order to preserve a maximum throughput rate of passengers 4 to 7.

In other words, the electronic control unit 41 generates an initial speed setpoint of the vehicles 3 when one passenger 4 to 7 at most is present on each track 65 to 67 of the frontal danger area 64, or when one passenger at most is present on each track of the safety area 68, i.e. when the configuration is valid. In this case, the electronic control unit 41 maintains movement of the vehicles 3 at the initial speed. When the electronic control unit 41 determines a dangerous or risk configuration, it adjusts the speed of the vehicles, respectively by stopping or reducing the speed. When the electronic control unit determines a valid configuration after a dangerous or a risk configuration, it accelerates the vehicles again, going from reduced speed to the initial speed.

The surveillance area 60, lateral collision areas 61, 62, frontal danger area 64 and safety area 68 can respectively have rectangular shapes, as represented in FIGS. 2 to 5. Areas 60 to 62, 64 and 68 can furthermore have other shapes such as half-circles, trapezoids or more generally a quadrilateral shape.

As a variant, the sizes of the safety area 68 and danger area 64 can vary according to the speed of movement of the vehicles 3. It can also be provided for the size of the safety area 68 and danger area 64 to be able to vary according to the position of the vehicle 3 in either the departure area 82, preparation area 81 or entry area 80. The size of the areas 64, 68 can increase when the speed of movement of the vehicles 3 increases, or be reduced when the speed of movement of the vehicles 3 is reduced. As a variant, the closer the vehicle 3 moves towards the departure area 80, the more the size of the safety area 68 and danger area 64 increase. According to another embodiment, the size of the areas 64 and 68 remains constant.

Figure 3:
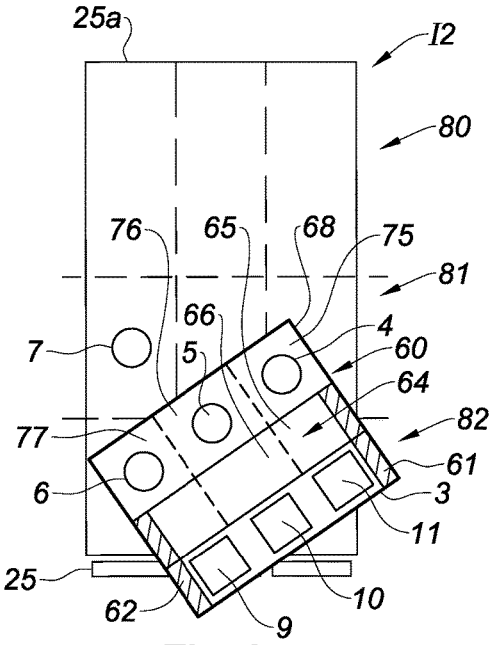
FIGS. 2 to 5 schematically illustrate top views of a boarding area of the installation.
Figure 5:
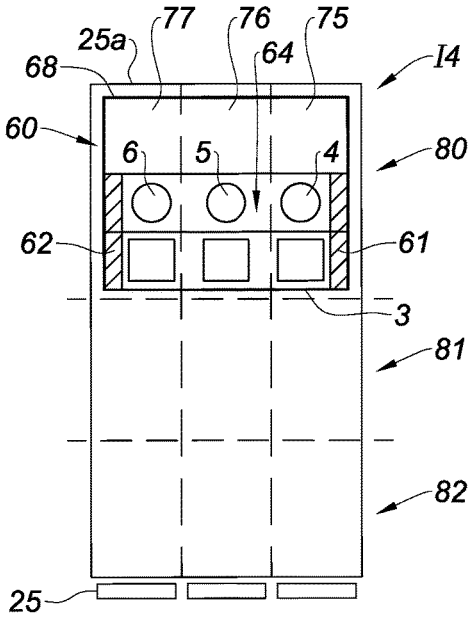
Figure 2:
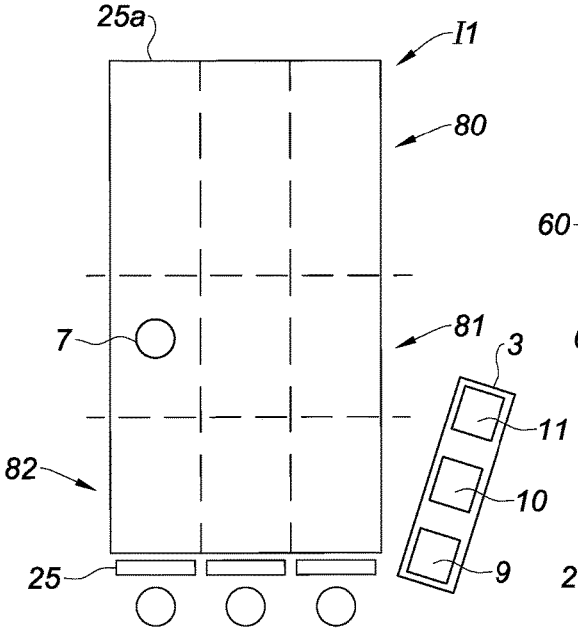
Figure 4:
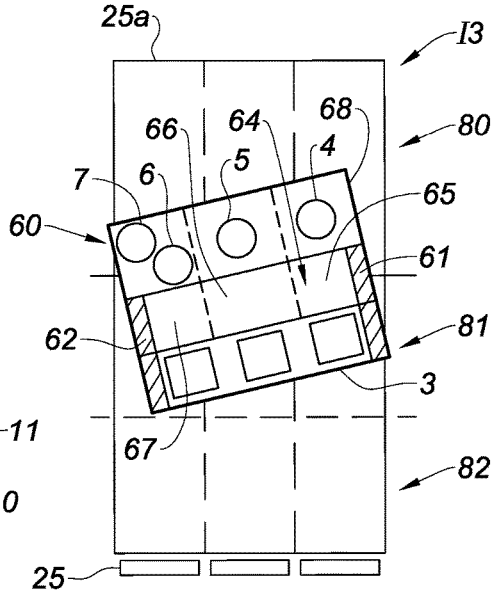

In FIG. 2, the vehicle 3 is situated outside the surveillance area 60, and movement of the vehicles 3 in the terminal 8 is performed with an initial speed of movement. In FIG. 3, the vehicle 3 is situated in the entry area 82 and three passengers 4 to 6 are respectively positioned on the three tracks of the safety area 68. In this case, the initial speed is maintained as the configuration is valid and does not present any danger. In FIG. 4, the vehicle 3 is situated in the preparation area 81 and a number of passengers 4 to 7 present in the safety area 68 is greater than the number of seats 9 to 11, in which case the speed is reduced and a speed setpoint is transmitted to the secondary motor 30 to move the vehicles with the second speed described in the foregoing. In FIG. 5, the configuration is valid, and the speed of movement is kept equal to the second speed or can be equal to the initial speed, and the vehicle can leave the terminal 8 with the passengers installed on the seats of the vehicle 3.

What is claimed is:

1. A cableway installation comprising at least one vehicle designed to be hauled by the cable, a loading terminal comprising a boarding area where passengers are positioned to board the vehicle, and a drive motor of the vehicle in the boarding area, comprising an image acquisition device generating at least one image representative of the vehicle and of the passengers in the boarding area, and an electronic control unit configured to determine a surveillance area around the vehicle and the positions of the passengers, in said at least one representative image, and to generate a speed setpoint for the motor according to the positions of the passengers in the surveillance area.

2. The cableway installation according to claim 1, comprising a support situated above the boarding area, the image acquisition device being mounted on the support directly above the boarding area.

3. The cableway installation according to claim 1, wherein the image acquisition device generates several representative images.

4. The cableway installation according to claim 1, wherein the image acquisition device is a digital video camera.

5. The cableway installation according to claim 1, wherein the image acquisition device is an infrared thermal camera.

6. The cableway installation according to claim 1, wherein the surveillance area comprises two lateral collision areas situated on each side of the vehicle and the electronic control unit generates a stop setpoint of the vehicle when at least one passenger is positioned in a lateral collision area.

7. Installation according to claim 1, wherein the vehicle is a chair comprising at least two seats to respectively seat at least two passengers.

8. The cableway installation according to claim 7, wherein the surveillance area comprises a frontal danger area situated to the front of the vehicle and the electronic control unit generates a stop setpoint of the vehicle when the number of passengers present in the frontal danger area is greater than the number of seats of the vehicle.

9. The cableway installation according to claim 8, wherein the frontal danger area comprises at least two tracks respectively situated facing said at least two seats of the vehicle, and the electronic control unit generates a stop setpoint of the vehicle when more than one passenger is present on at least one track of the frontal danger area.

10. The cableway installation according to claim 8, wherein the surveillance area comprises a safety area situated to the front of the frontal danger area and comprising at least two tracks respectively situated facing said at least two of the vehicle, and the electronic control unit generates an initial speed setpoint of the vehicle when one passenger at most is present on each track of the safety area.

11. The cableway installation according to claim 10, wherein the electronic control unit generates a speed setpoint lower than the initial speed of the vehicle when more than one passenger is present on at least one track of the safety area.

12. The cableway installation according to claim 10, wherein the electronic control unit generates a speed setpoint lower than the initial speed of the vehicle when the number of passengers present in the safety area is greater than the number of seats of the vehicle.

13. The cableway installation according to claim 8, wherein the boarding area comprises a departure area, and the electronic control unit generates a stop setpoint of the vehicle when the vehicle is positioned in the departure area and when the number of passengers present in the frontal danger area is greater than the number of seats of the vehicle.

14. The cableway installation according to claim 13, wherein the electronic control unit generates a stop setpoint of the vehicle when the vehicle is positioned in the departure area and more than one passenger is present on at least one track of the frontal danger area.

* * * * *